US009724556B1

(12) United States Patent
Otto

(10) Patent No.: US 9,724,556 B1
(45) **Date of Patent: *Aug. 8, 2017**

(54) EXERCISE BAR

(71) Applicant: Patrick Mike Otto, Sandwich, IL (US)

(72) Inventor: Patrick Mike Otto, Sandwich, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/987,475

(22) Filed: Jan. 4, 2016

Related U.S. Application Data

(63) Continuation of application No. 13/954,896, filed on Jul. 30, 2013, now Pat. No. 9,254,408.

(60) Provisional application No. 61/677,369, filed on Jul. 30, 2012.

(51) Int. Cl.
*A63B 21/072* (2006.01)
*A63B 21/00* (2006.01)

(52) U.S. Cl.
CPC ..... *A63B 21/0724* (2013.01); *A63B 21/4035* (2015.10)

(58) Field of Classification Search
CPC ..... A63B 21/0557; A63B 21/0724
USPC ..... 482/121–129, 139
See application file for complete search history.

(56) References Cited

U.S. PATENT DOCUMENTS

| | | | | |
|---|---|---|---|---|
| 389,622 | A * | 9/1888 | Wild | 482/126 |
| 1,956,498 | A * | 4/1934 | Duke | 482/126 |
| 4,406,453 | A | 9/1983 | Herzfeld | |
| 4,461,473 | A | 7/1984 | Cole | |
| 4,623,146 | A | 11/1986 | Jackson | |
| 4,629,184 | A | 12/1986 | Selkee | |
| 4,743,018 | A | 5/1988 | Eckler | |
| 5,152,731 | A | 10/1992 | Troutman | |
| 5,334,113 | A | 8/1994 | Roepke | |
| 7,056,268 | B2 | 6/2006 | Emick | |
| 2003/0134716 | A1 | 7/2003 | Yu | |

* cited by examiner

*Primary Examiner* — Loan H Thanh
*Assistant Examiner* — Rae Fischer
(74) *Attorney, Agent, or Firm* — Hamilton IP Law, PC; Jay R. Hamilton; Charles Damschen

(57) ABSTRACT

An exercise bar having a frame and a pair of rails positioned interiorly of the ends of a frame. A pair of moveable handles engaged with and mounted upon the rails. The moveable handles have a user grip. A pair of spring assemblies is located at each end of the frame and attached therein between and to the frame and one end of each respective moveable handle. During exercise, a user place weights on the outer ends of the frame and may then move the exercise bar in a general vertical swinging motion up or down, similar to existing barbells, and add additional stress via a compound movement by moving the handles in towards the center of the load and concurrently handle towards the center of the exercise bar to produce a transverse stress upon the user and user's musculature.

6 Claims, 5 Drawing Sheets

EXERCISE BAR

CROSS-REFERENCE TO RELATED APPLICATIONS

Applicant states that this utility patent application is a continuation of and claims priority from U.S. patent application Ser. No. 13/954,896 filed on Jul. 30, 2013, which Application claimed priority under 35 U.S.C. 119(e) from provisional U.S. Pat. App. No. 61/677,369 filed on Jul. 30, 2012, all of which are incorporated by reference herein in their entireties.

FIELD OF THE INVENTION

The present invention relates to an apparatus and method for exercising, including bars and barbells for working muscles to fatigue for producing adaptations in the human leading to increases strength, mass and or flexibility and more specifically, for an apparatus and method that exercises muscles perpendicular or lateral to the general direction of a movement which is generally vertical.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

AUTHORIZATION PURSUANT TO 37 C.F.R. §1.171 (d)

A portion of the disclosure of this patent document may contain material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

SUMMARY OF INVENTION

This apparatus can be used to work a various muscle groups throughout various movements and range of motions. For many exercises one can decide upon three different grips, supinated, pronated, or neutral. The type of grip that is used during an exercise will affect the angle of the muscles worked but will still use the same muscle groups.

The muscles worked are dependent upon the upward and downward movement phase of each exercise. When performing a backward pulling motion the primary muscles trained will be latissimus dorsi, teres major, rhomboid, and posterior deltoid. Three other primary muscles that can be activated by utilizing a pulling motion with this exercise bar are the biceps brachii, brachialis, and brachioradialis. If the bar is used lying in a supine position performing a pushing motion the primary muscles that will be activated are the pectoralis major, anterior deltoid, and the triceps brachii.

There are other supporting muscles that are involved in stabilizing the torso throughout each movement activity that may be performed. The erector spinae, rectus abdominis, and the internal and external obliques all play vital roles in providing proper postural alignment and foundational core strength.

There are a multitude of exercises that can be performed using this exercise bar they include but are not limited to: bicep curl, hammer curl, lying chest press, lying triceps extension, should press, bent over row, and squat.

BRIEF DESCRIPTION OF THE DRAWINGS

In order that the advantages of the invention will be readily understood, a more particular description of the invention briefly described above will be rendered by reference to specific embodiments illustrated in the appended drawings.

Understanding that these drawings depict only typical embodiments of the invention and are not therefore to be considered limited of its scope, the invention will be described and explained with additional specificity and detail through the use of the accompanying drawings.

DETAILED DESCRIPTION—ELEMENT LISTING

Figure 1:
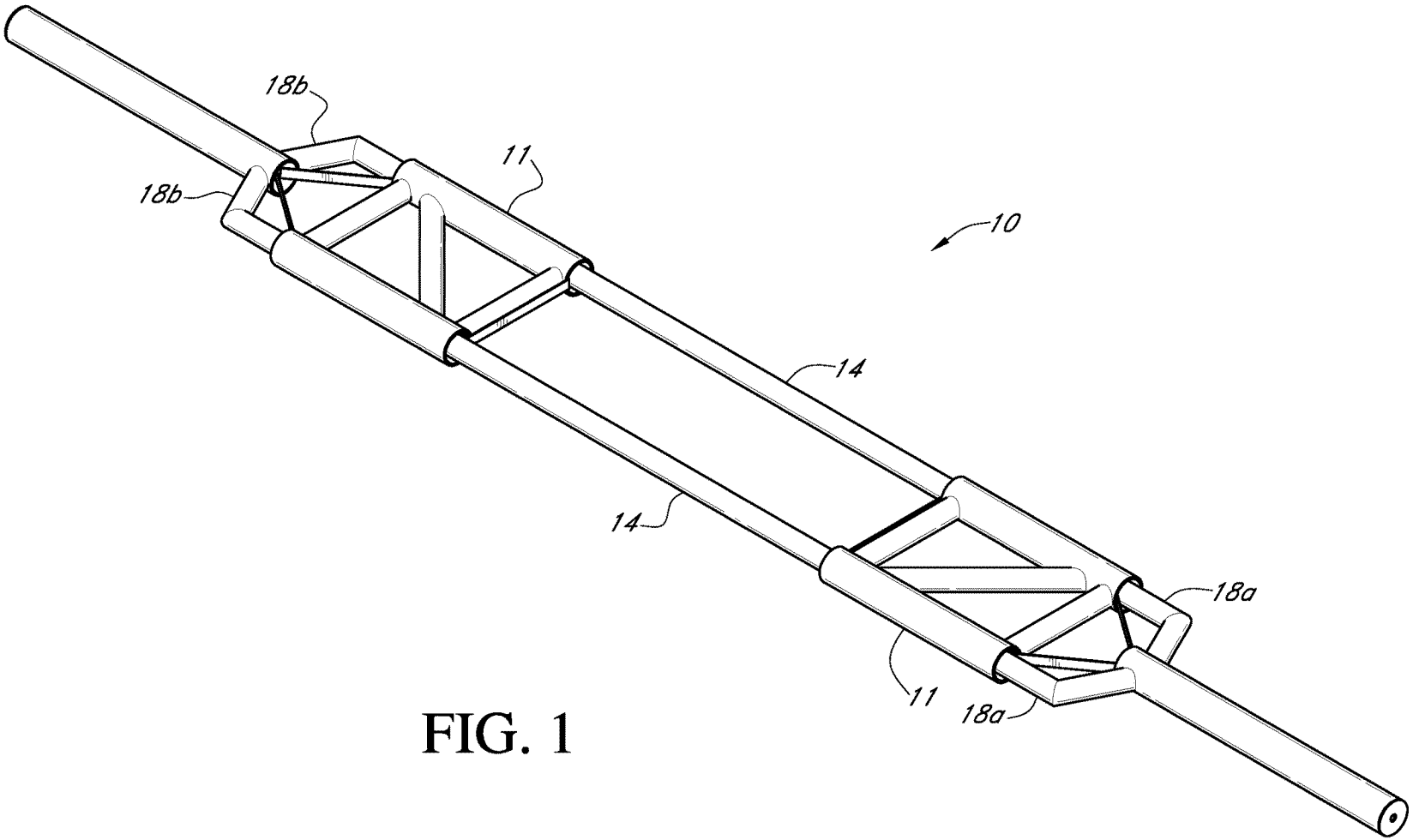
FIG. 1 is a perspective view of exercise bar.

| Description | Element No. |
|---|---|
| Exercise Bar | 10 |
| Handle | 11 |
| Grip | 12 |
| Spring Assembly | 13 |
| Rail(s) | 14 |
| Weight loading surface | 15 |
| User | 16 |
| User hand | 17 |
| Frame | 18 |
| Angled portion | 19 |

DETAILED DESCRIPTION

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

Illustrative Embodiment

Figure 2:
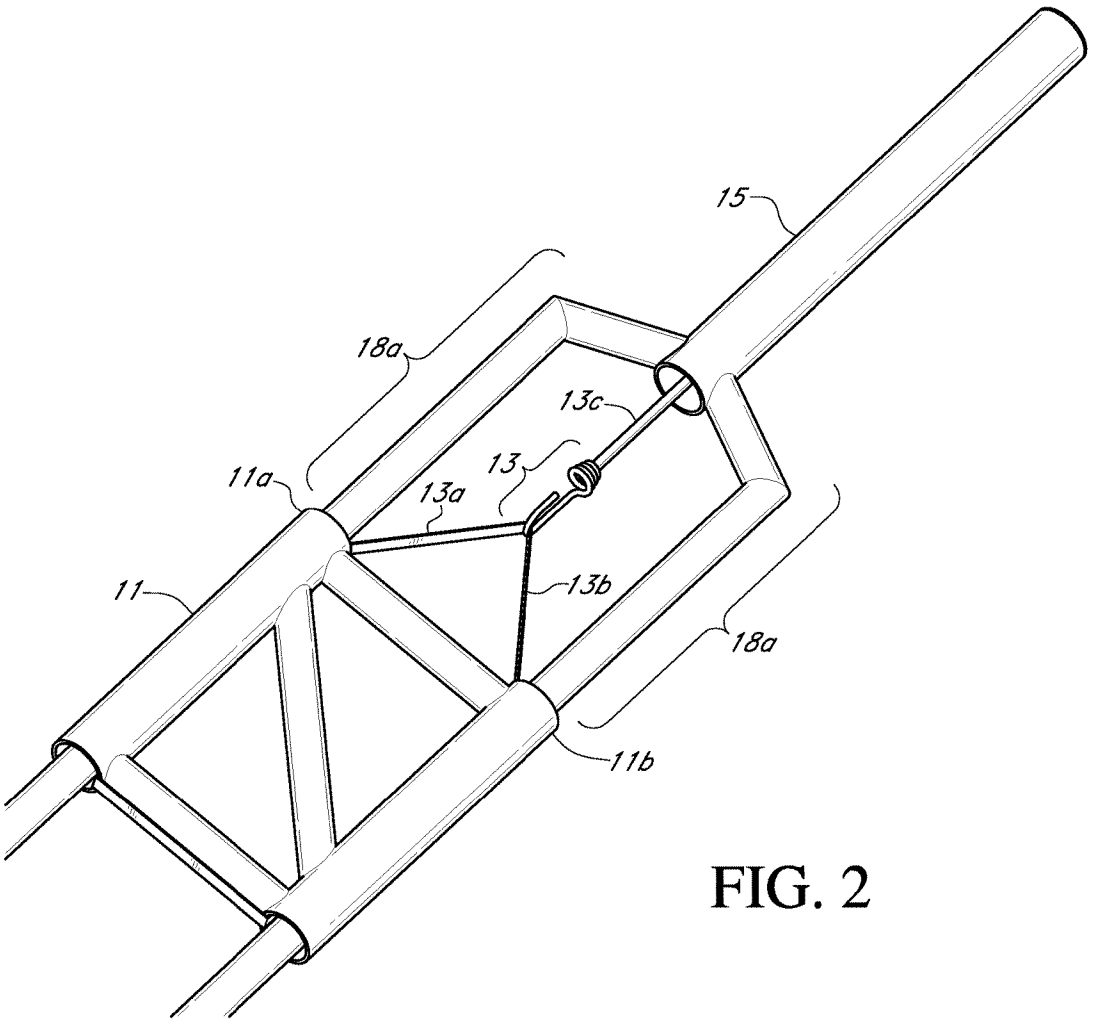
FIG. 2 is a detailed view of the tension mechanism of the exercise bar.

FIGS. 1 and 2 illustrate one embodiment of the invention. As shown the exercise bar 10 is composed of a frame 18 having a pair of rails 14 and having distal ends 18*a*, 18*b*. A weight loading surface 15 is positioned at both ends of the frame 18. Typically, users will load weights or weigh plates onto surface 15, which is not shown but well known in the prior art. A pair of handles 11 are engaged with and ride upon the pair of rails 14 comprising the frame 18 as shown in the illustrative embodiments as illustrated by FIGS. 1-5. The each end of the rails 14 terminate at an angled portion 19 which connects to the end of the frame 18 and the weight loading surface 15. As shown in FIGS. 1-4 the angled portion 19 is at angle of approximately forty-five degrees in relation to the frame ends and rails but other angles may be selected based on the preference of the designer or fabricator without departure from the scope of the present disclosure.

Other embodiments, not shown, may have a frame 18 constructed with a pair of handles 11 riding on a frame comprised of a single rail by one of ordinary skill without departure from the spirit of the disclosure. Also, as one of ordinary skill will appreciate, the frame 18, pair of rails 14, moveable handles 11 and weight loading surfaces may be constructed from any one of a number of materials including steel, aluminum and or plastic, without limitations, solely dependent on the best means of production, fabrication and the preference of the user 17. As shown, each moveable handle 11 has a user grip 12 and a first and second end 11*a*, 11*b*. As one of one skill will appreciate, the moveable handles 11 and user grip 12 may be configured with knurling or padding (not shown), dependent upon user preference, and incorporate other geometries or configurations, without departure from the spirit of the disclosure. The handle as shown has a plurality of grips 12 including without limitation two that are parallel with the pair of rails (12*b*, 12*e*), one that is perpendicular with the pair of rails (12*a*) and one that is angled (12*d*) in relation to the pair of rails.

Figure 5:
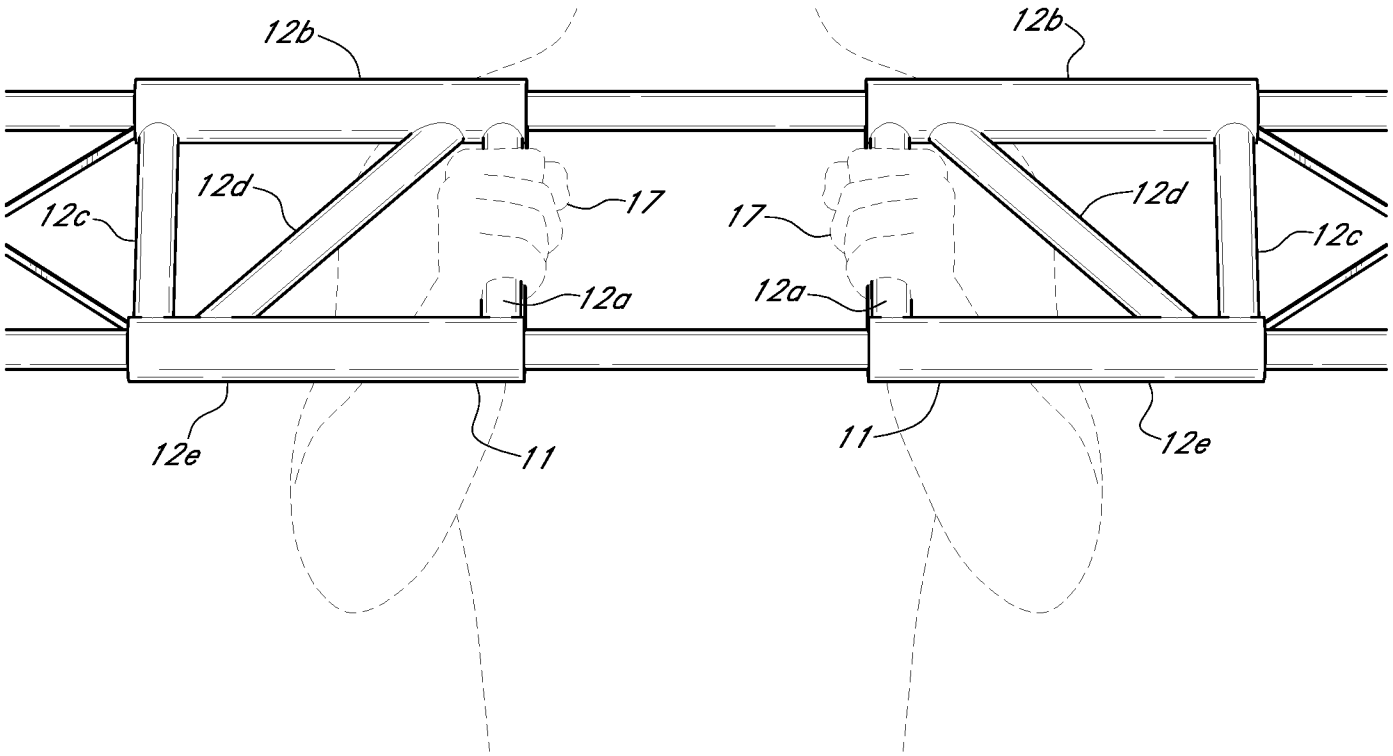
FIG. 5 is detailed view of the exercise bar of FIG. 4 provides details as to the different grips of the handle.

As exemplified by FIG. 5, a user may choose to engage the exercise bar handle in a multitude of grip positions (12*a*-12*e*) to perform different exercises engaging different or additional muscles. For example, and without limitation, a user 17 may move their grip to position 12*e* to perform an exercise similar to a hammer curl to target the brachioradialis while allowing for working of the synergistic brachialis and biceps brachii muscle groups. This same exercise will also work the stabilizing muscle groups such as and including the deltoids (anterior), trapezius (upper and middle) as well as the levator scapulae, flexor carpi radialis and extensor carpi radialis. One of ordinary skill will appreciate then that user 17 may grip the other positions 12*a*, 12*b*, 12*c* and 12*d* of the handle during exercise and some or all of the muscles discussed to the benefit of the user and solely as preferred by the user.

Figure 3:
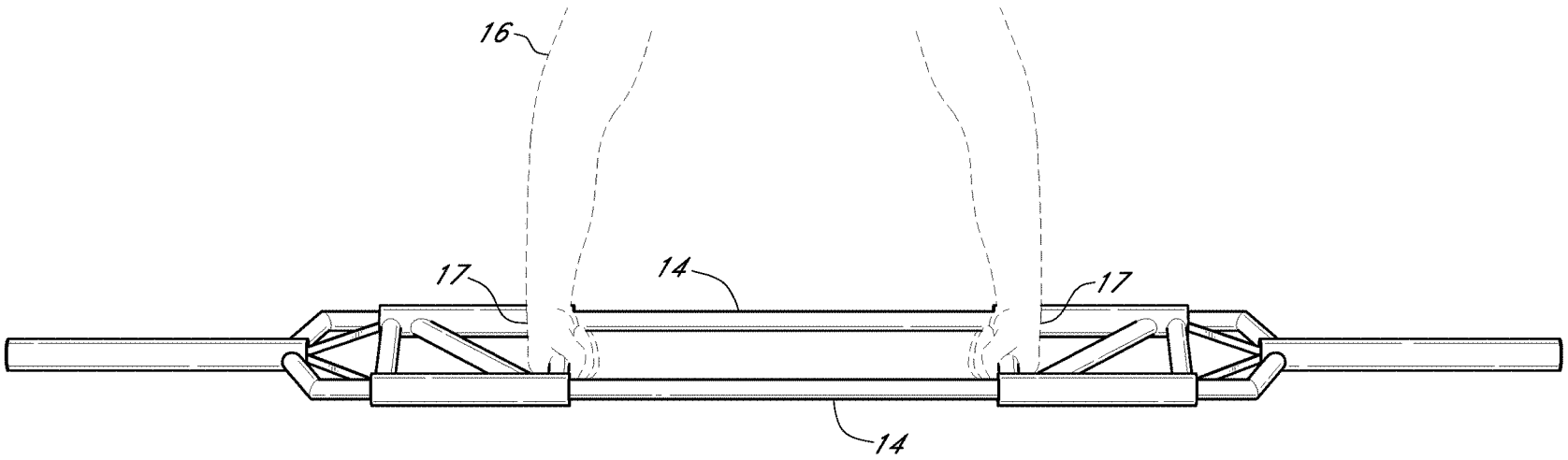
FIG. 3 is a front view of the exercise bar as used at initiation of a movement.
Figure 4:
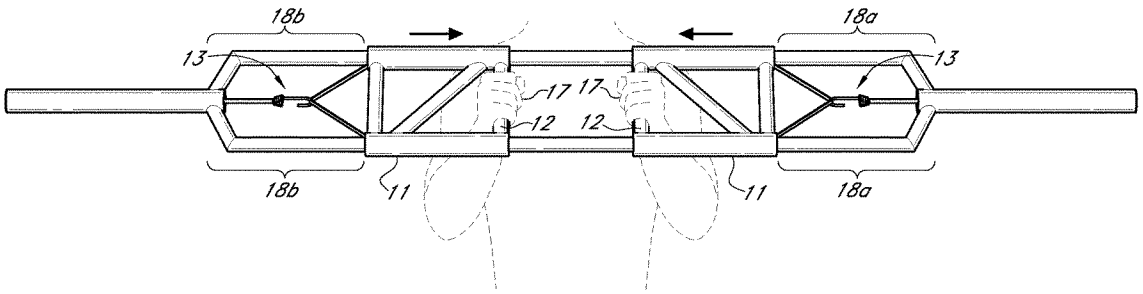
FIG. 4 is front view of the exercise bar as used at the end of a movement.

As exemplified by FIGS. 3-5, a pair of spring assemblies 13 is used to generate additional tension upon the user increasing the load or stress on the user's muscles during movement of the moveable handles 11 along the pair of rails 14 of frame 18. FIGS. 1-5 illustrate that each spring assembly 13 is composed of a loop portion 13*a* affixed at one end of handle 11. As shown, the loop 13*a* is affixed between the top and bottom of the handle (11*a*, 11*b*), respectively. (See FIG. 2) This is but one way to attach this loop 13*a* as will be obvious to one of ordinary skill. A first end of the tensioning member 13*b* is then connected to the loop 13*a*. The second end of the tensioning member 13*c* is affixed to the inside of the weight loading surface 15, which is illustrated as a tubular or cylinder like structure. This is but one way to attach the spring assembly 13 between the handle 11 and the end of the frame 18 as will be obvious to one of ordinary skill. As will be obvious to one of ordinary skill, the spring assembly 13 shown is but one means by which to place load upon the handles 11 as they move along the frame 18. Other springs and tension systems will be obvious to one of ordinary skill in the art. Although not shown, a threaded cap may be positioned at the distal end of the weight loading surface 15 to which the second of the tensioning member 13*c* may be affixed allowing removal and replacement or repair of the tensioning member.

Illustrative Method of Use

The illustrative method of exercising as disclosed herein comprises positioning a weight (not shown) on either end of a frame 18, illustrated herein as weight loading surface 15. Engaging a user 17 with a grip portion 12 located on the handle 11 positioned interior the frame ends (18*a*, 18*b*). An exercise movement is then initiated from a first position (illustrated at FIG. 3) in substantially a first direction with concurrent movement of the handles 11 from a first position during the exercise movement in a direction substantially perpendicular to the first direction and then terminating the exercise movement in a second position (illustrated at FIG. 4) wherein the moveable handles 11 are also in a second position. One of ordinary skill will appreciate from the preceding description that the handles 11 moving in the first direction placed a load on each spring assembly 13 as the handle 11 traveled from the outer portion of frame 18 to the inner portion on rails 14.

In the exemplary exercise depicted in FIGS. 3-5, users swing the weight up towards their chest in a curling motion, the moveable handles allowing the users grip to move in a transverse manner to the direction of travel (inward or outward) along the frame. This transverse movement during the upward movement may also be under tension, to produce additional beneficial stress to the user's muscles, as previously discussed.

Having described the preferred embodiments, other features of the exercise bar and method of use will undoubtedly occur to those versed in the art, as will numerous modifications and alterations in the embodiments as illustrated herein, all of which may be achieved without departing from the spirit and scope of the exercise bar 10 and/or method of use. It should be noted that the exercise bar 10 and method of use are not limited to the specific embodiments pictured and described herein, but are intended to apply to all similar apparatuses and methods for putting a physical load on a user during exercise for the purpose of generating muscle adaptations. Modifications and alterations from the described embodiments will occur to those skilled in the art without departure from the spirit and scope of the exercise bar 10 and/or method of use.

The invention claimed is:

1. An exercise bar comprising:

a) a frame comprising:

i) a first rail having a first end, a center and a second end;

ii) a second rail having a first end, a center and a second end, wherein said first rail and second rail are in parallel relation and substantially in a single plane;

iii) a first weight loading surface, wherein the first end of the first rail and the first end of the second rail terminate at and are connected to the first weight loading surface;

iv) a second weight loading surface, wherein the second end of the first rail and the second end of the second rail terminate at and are connected to the second weight loading surface;

b) a first handle and a second handle positioned on the frame, wherein the first handle is positioned proximate the first end of the frame and the first weight bearing surface and the second handle is positioned proximate the second end of the frame and the second weight bearing surface;

c) a first spring assembly positioned within the first weight bearing surface, wherein the first spring assembly is attached at a first end to the interior of the first weight bearing surface and the spring assembly is connected at a second end to the first handle;

d) a second spring assembly positioned within the second weight bearing surface, wherein the second spring assembly is attached at a first end to the interior of the second weight bearing surface end and the spring assembly is connected at a second end to the second handle; and, e) wherein each handle may move laterally along the frame towards the frame center via the first and the second rail under tension induced by the first and the second spring assemblies.

2. The exercise bar according to claim 1 wherein the frame contains an angled portion at each end, the angled portion connecting the first and the second rails to the ends of the frame.

3. The exercise bar according to claim 2 wherein each handle has a plurality of grips.

4. The exercise bar according to claim 3 wherein at least one of the plurality of grips is positioned parallel with the pair of rails.

5. The exercise bar according to claim 3 wherein at least one of the plurality of grips is positioned perpendicular to the pair of rails.

6. The exercise bar according to claim 4 wherein at least one of the plurality of grips is positioned at an angle to the pair of rails.

* * * * *